US007416182B2

(12) United States Patent
Nishida et al.

(10) Patent No.: US 7,416,182 B2
(45) Date of Patent: Aug. 26, 2008

(54) PAPER SKEW CORRECTING DEVICE AND BILL DEPOSITING/DISPENSING APPARATUS

(75) Inventors: Mitsutaka Nishida, Inagi (JP); Hayato Minamishin, Inagi (JP); Taisuke Hyodo, Inagi (JP)

(73) Assignees: Fujitsu Limited, Kawasaki (JP); NCR Corporation, Dayton, OH (US)

( * ) Notice: Subject to any disclaimer, the term of this patent is extended or adjusted under 35 U.S.C. 154(b) by 0 days.

(21) Appl. No.: 11/519,793

(22) Filed: Sep. 13, 2006

(65) Prior Publication Data

US 2007/0007719 A1 Jan. 11, 2007

Related U.S. Application Data

(63) Continuation of application No. PCT/JP2005/004435, filed on Mar. 14, 2005.

(30) Foreign Application Priority Data

Mar. 15, 2004 (JP) ..... 2004-073608

(51) Int. Cl.
*B65H 7/02* (2006.01)

(52) U.S. Cl. ..... 271/228; 271/227; 271/249

(58) Field of Classification Search ..... 271/228, 271/227, 236, 249
See application file for complete search history.

(56) References Cited

U.S. PATENT DOCUMENTS 3,175,824 A 3/1965 Albosta ..... 271/52
5,683,078 A * 11/1997 Schieck ..... 271/250

FOREIGN PATENT DOCUMENTS

| | | |
|---|---|---|
| JP | 60-82553 | 5/1985 |
| JP | 61-12556 | 1/1986 |
| JP | 62-197643 | 12/1987 |
| JP | 2-249854 | 10/1990 |
| JP | 5-4755 | 1/1993 |
| JP | 6-115767 | 4/1994 |
| JP | 8-67377 | 3/1996 |
| KR | 10-2006-7021210 | 10/2007 |

* cited by examiner

*Primary Examiner*—Patrick Mackey
*Assistant Examiner*—Kaitlin S Joerger
(74) *Attorney, Agent, or Firm*—Kratz, Quintos & Hanson, LLP

(57) ABSTRACT

The present inventions are a paper skew correcting device and a bill depositing/dispensing apparatus. The paper skew correcting device comprises first and second driving rollers 21 and 22 disposed on the left and right sides of a conveying route for paper 2 and first and second driven rollers 23 and 24 with narrow contact faces placed opposite to the first and second driving rollers 21 and 22 via the conveying route. The second driving roller 22 is formed in a tapered roller with a tapered outer peripheral surface and its rotation shaft 22*a* is provided aslant so that the contact part of the tapered roller is almost parallel with the conveying route. The second driven roller 24, corresponding to the second driving roller 22, is laterally moved according to the skew angle of the conveyed paper 2 so as to change its contact position with the second driving roller 22 so that the feeding speed of the right side of the paper 2 can be accelerated or decelerated to correct the skew paper.

20 Claims, 11 Drawing Sheets

PAPER SKEW CORRECTING DEVICE AND BILL DEPOSITING/DISPENSING APPARATUS

CROSS REFERENCE TO RELATED APPLICATION

This application is a continuation of PCT application PCT/JP2005/004435 which was filed on Mar. 14, 2005.

BACKGROUND OF THE INVENTION

1. Field of the Invention

The present invention relates to a paper skew correcting device for correcting paper skew (papers inclined and conveyed askew) conveyed on a belt or the like through a processing device, and more particularly, relates to a paper skew correcting device and a bill depositing/dispensing apparatus that use the skew correcting device, which can correct various types of paper skew of different paper sizes, paper quality and the like, with high accuracy, without creasing any piece of paper.

2. Description of the Related Art

A conventional paper skew correcting device may be seen in Japanese Patent Application Publication No. H6-115767, which proposes a conventional paper skew correcting device. In FIGS. 11A and 11B of that Publication, a conventional paper skew correcting device 100 comprises a pair of tapered rollers 111 and 112 disposed on a driving shaft 110 at a predetermined interval in such a way that their respective small diameter end surfaces are opposed to each other at the center of a paper conveying route and a pair of pinch rollers 121 and 122 which are provided for a driven shaft 120 in such a way as to press the tapered rollers 111 and 112. The pinch rollers 121 and 122 are provided along the driven shaft 120 in such a way that they can slide along the shaft, and pushing both sides of each of the pinch rollers 121 and 122 by springs 123*a* and 123*b*, and 124*a* and 124*b*, respectively, which are pierced through the driven shaft 120, regulates the slides.

In a configuration such as the conventional paper skew correcting device 100, the stress generated when paper moves askew is applied to each of the pinch rollers 121 and 122, the pinch rollers 121 and 122 move and change the pressing position of each of the tapered rollers 111 and 112 to automatically correct the paper skew.

However, in the above-described conventional paper skew correcting device 100, since the driving shaft 110 pierces through the center of each of the tapered rollers 111 and 112 and the driving shaft 110 and the driven shaft 120 are fixed in parallel to each other in a specific position, both types of rollers lose contact with each other when either of the pinch rollers 121 or 122 that touch on the center of the tapered surface of each of the tapered rollers 111 and 112 moves to the small diameter side of the tapered surface. Therefore, paper skew cannot be corrected for this structural reason.

Furthermore, in the above-described conventional paper skew correcting device 100, although paper skew are corrected by moving each of the pinch rollers 121 and 122 using the stress generated when papers move askew, the amount of movement of each of the pinch rollers 121 and 122 depends on the elasticity of the springs 123*a* and 123*b*, and 124*b* and 124*b*, respectively. However, since the stress generated when papers move askew varies depends on variables such as the size of the papers, paper quality, and so forth, the springs 123*a*, 123*b*, 124*b* and 124*b*, which possess specific elasticity, cannot completely correct various types of paper skew.

For example, although high reliability is required for a bill depositing/dispensing apparatus simultaneously capable depositing and/or dispensing bills of several countries, paper skew are easily caused, which in turn causes jams or poor reading of the bill type since bill sizes vary for each respective country. Thus, although more highly accurate paper skew correction is required for such a bill depositing/dispensing apparatus, such highly accurate paper skew correction cannot be realized by correcting paper skew using the stress generated when papers move askew, such as in the above-described conventional paper skew correcting device 100.

Furthermore, although it is preferable in a bill depositing/dispensing apparatus for a bill fed to a customer to have no creases and folds, in the conventional paper skew correcting device 100, there is a possibility that creases, folds or breaks may be caused when each of the pinch rollers 121 and 122 for pressing papers moves along each of the tapered rollers 111 and 112. Therefore, the conventional paper skew correcting device 100 cannot be applied to the correction of paper skew in a bill depositing/dispensing apparatus.

Patent reference 1: Japanese Patent Application Publication No. H 6-115767

SUMMARY OF THE INVENTION

The present invention has been made in order to solve the above-described problem and has as its object the provision of a paper skew correcting device and a bill depositing/dispensing apparatus which can correct various types of paper skew of different paper sizes, paper quality and the like, with high accuracy, and without creasing any piece of paper.

In order to attain this objective, the first paper skew correcting device of the present invention comprises first and second driving rollers disposed on the left and right sides of a paper conveying route and first and second driven rollers with narrow contact surfaces disposed opposite to the first and second driving rollers via the conveying route. The first and second driving rollers touch the first and second driven rollers, respectively, and papers are pinched by their left and right sides and are fed into the device. One of the first and second driving rollers is formed in a tapered roller with a tapered outer peripheral surface and its rotation shaft is placed aslant in such a way that the contact part of the tapered roller is nearly parallel with the conveying route. By laterally moving one of the first and second driven rollers disposed oppositely to the tapered roller, according to the skew angle of the conveyed papers in order to change its contact position with the tapered roller, the feeding speed of the left or right side of the papers can be accelerated or decelerated to correct the paper skew.

In order to attain the objective, the second paper skew correcting device of the present invention comprises first and second driving rollers disposed on the left and right sides of a paper conveying route and first and second driven rollers with narrow contact surfaces disposed opposite to the first and second driving rollers via the conveying route. The first and second driving rollers touch the first and second driven rollers, respectively, and papers are pinched by their left and right sides and are fed into the device. Both of the first and second driving rollers are formed in tapered rollers with a tapered outer peripheral surface, the respective large or small diameter end surfaces of these tapered rollers are symmetrically disposed in such a way as to be opposed to each other, and each rotation shaft is provided aslant in such a way that the contact part of each tapered roller can be nearly parallel with the conveying surface. Simultaneously, by laterally moving the first and second driven rollers disposed opposite to the tapered rollers according to the skew angle of the conveyed paper in order to change its contact position with each tapered roller, the feeding speed of the left or right side of the paper can be accelerated as the feeding speed of the other is decelerated. Thus, the paper skew can be corrected.

Preferably, the first and second driving rollers should be driven by the same driving source, and in the case of the above-described second paper skew correcting device, the first and second driven rollers should be fixed on the same axis and be simultaneously moved laterally by the same driving source.

Preferably, as for a means for laterally moving the first and/or second driven rollers, a pulse motor having a small pulley provided for a driving shaft, a pulley lever with a lever unit extending in the direction orthogonal to its rotation shaft provided for a large pulley, a timing belt for conveying the rotation of the small pulley to the large pulley and a sliding member, on which the first and/or second driven rollers are mounted, and that is connected to the pulley lever and moves linearly leftward or rightward when receiving the driving force of the pulse motor should be provided.

Additionally, the first and/or second driven rollers should be positioned at the home positions relative to the first and/or second driving rollers on the basis of the output signals from one or more photo-sensors for detecting a detection flag provided for the sliding member.

Furthermore, in order to attain the objective, the bill depositing/dispensing apparatus of the present invention comprises the above-described paper skew correcting device on the middle of the conveying route to correct paper skew.

According to the first paper skew correcting device of the present invention, when laterally moving one of the driven rollers that touches the tapered roller according the skew angle of conveyed papers, the peripheral speed of the tapered roller changes. Thus, the feeding speed of only one of the left or right sides of the papers can be accelerated or decelerated, thereby correcting paper skew with high accuracy without applying unnecessary force.

If two driving rollers are tapered rollers such as the second paper skew correcting device of the present invention, and the paper skew are corrected by simultaneously moving two driven rollers that touch these tapered rollers to the left or right, the amount of movement of each of the driven rollers can be reduced by half, thereby correcting paper skew more rapidly.

If in the above-described first or second paper skew correcting device, two driving rollers are driven by the same driving source, or, if in the above-described second paper skew correcting device, the first and second driven rollers are fixed on the same axis and are simultaneously moved by the same driving source, the composition of the entire paper skew correcting device can be simplified, thereby simplifying its control, reducing the number of operational failures and reducing its cost.

If the driving force of the pulse motor is conveyed via small and large pulleys and the first and/or second driven rollers are laterally moved, the first and/or second driven rollers can be finely moved by one step of the pulse motor by increasing the size ratio between the large and small pulleys, thereby correcting paper skew with high accuracy.

Furthermore, if the first and/or second driven rollers are positioned at the home positions relative to the first and/or second driving rollers because of the detection of a detection flag provided for the sliding member by one or more photo-sensors, the first and/or second driven rollers can be accurately returned to their home positions, thereby correcting paper skew with high accuracy in corporation with the above-described fine movement of the first and/or second driven rollers by the pulse motor.

In addition, according to the bill depositing/dispensing apparatus of the present invention, by using the above-described paper skew correcting device of the present invention for the correction of paper skew, jamming and poor bill-type reading due to paper skew while being conveyed can be unerringly prevented, thereby enabling one bill depositing/dispensing apparatus to simultaneously handle various bill types of different countries of different sizes and paper quality.

BRIEF DESCRIPTION OF THE DRAWINGS

FIGS. 9A and 9B show skewed paper whose feeding speed must be accelerated and the one whose feeding speed must be decelerated.

FIGS. 11A and 11B are its top view and front view, respectively.

DESCRIPTION OF THE PREFERRED EMBODIMENTS

The paper skew correcting device in one aspect of the present invention and the bill depositing/dispensing apparatus in one aspect of the present invention are described below with reference to the drawings. In this embodiment, the paper skew correcting device is installed as a part of a bill depositing/dispensing apparatus, such as an automated teller machine (ATM) or similar devices in order to correct skewed paper bills.

Figure 1:
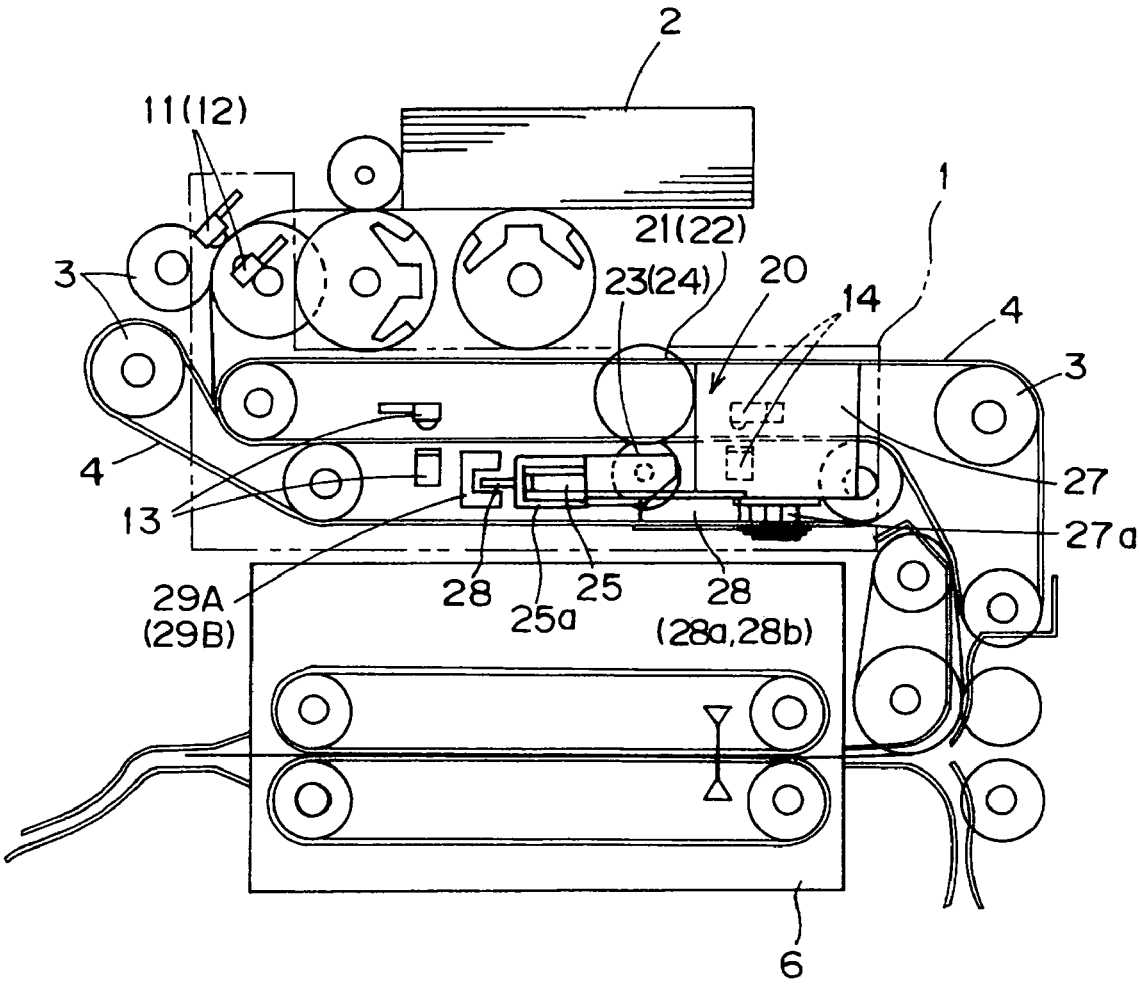
FIG. 1 shows an outline of the bill depositing/dispensing apparatus in one aspect of the present invention and the paper skew correcting device constituting it in one aspect of the present invention.
Figure 2:
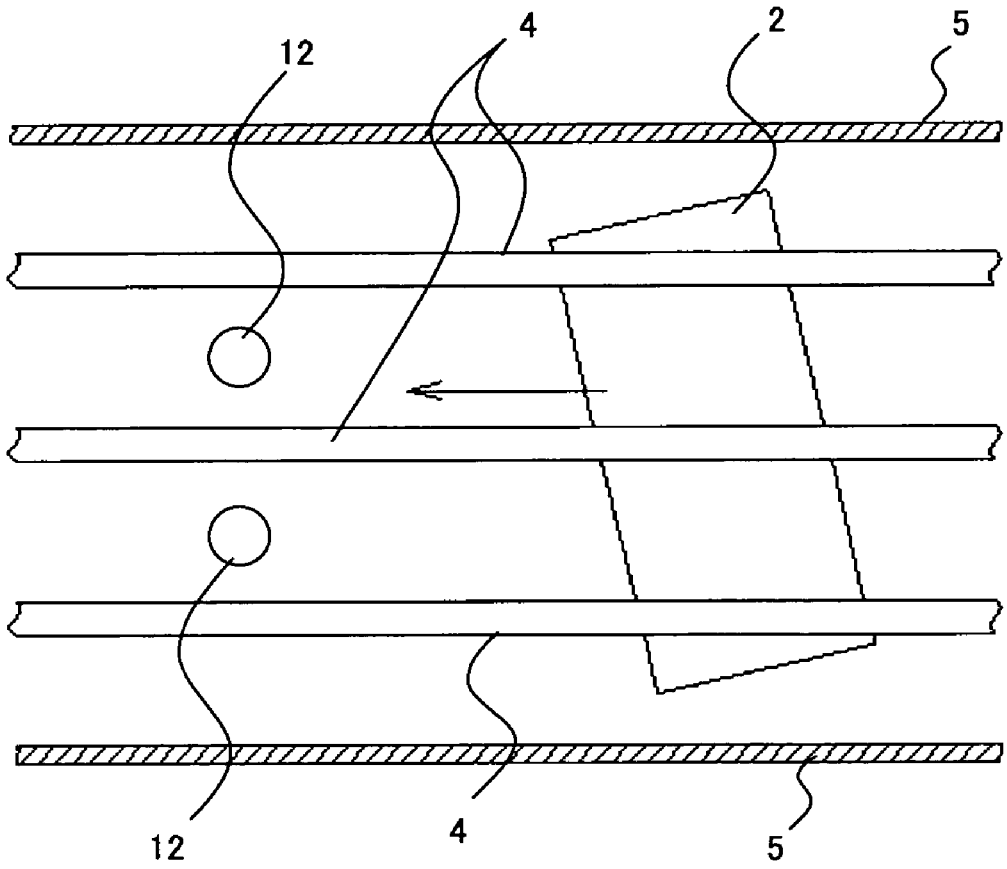
FIG. 2 is a top view showing the disposition of L and R sensors for detecting paper skew.
Figure 3:
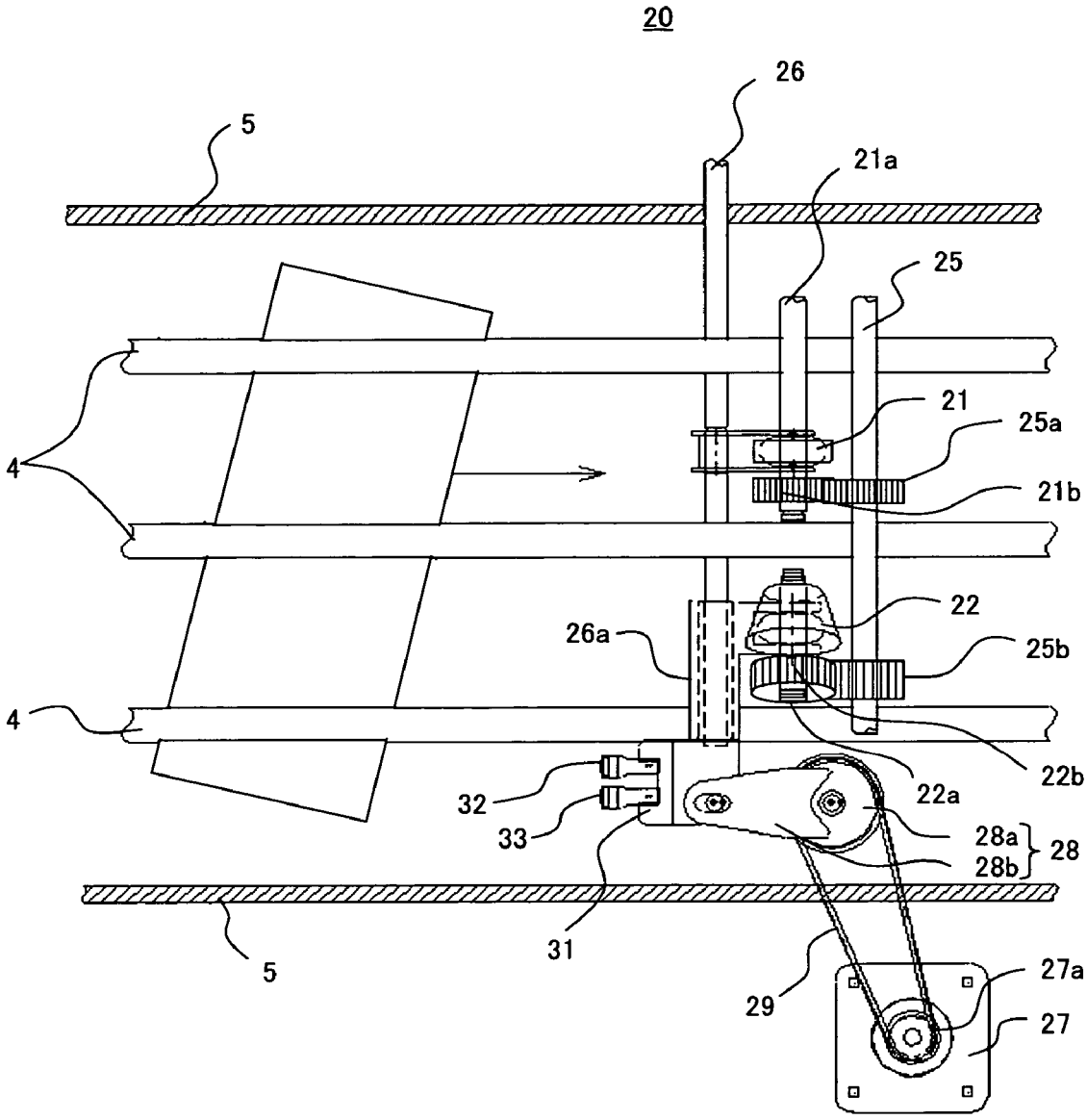
FIG. 3 is a top view of the skew correction unit that is the major part of the paper skew correcting device.
Figure 4:
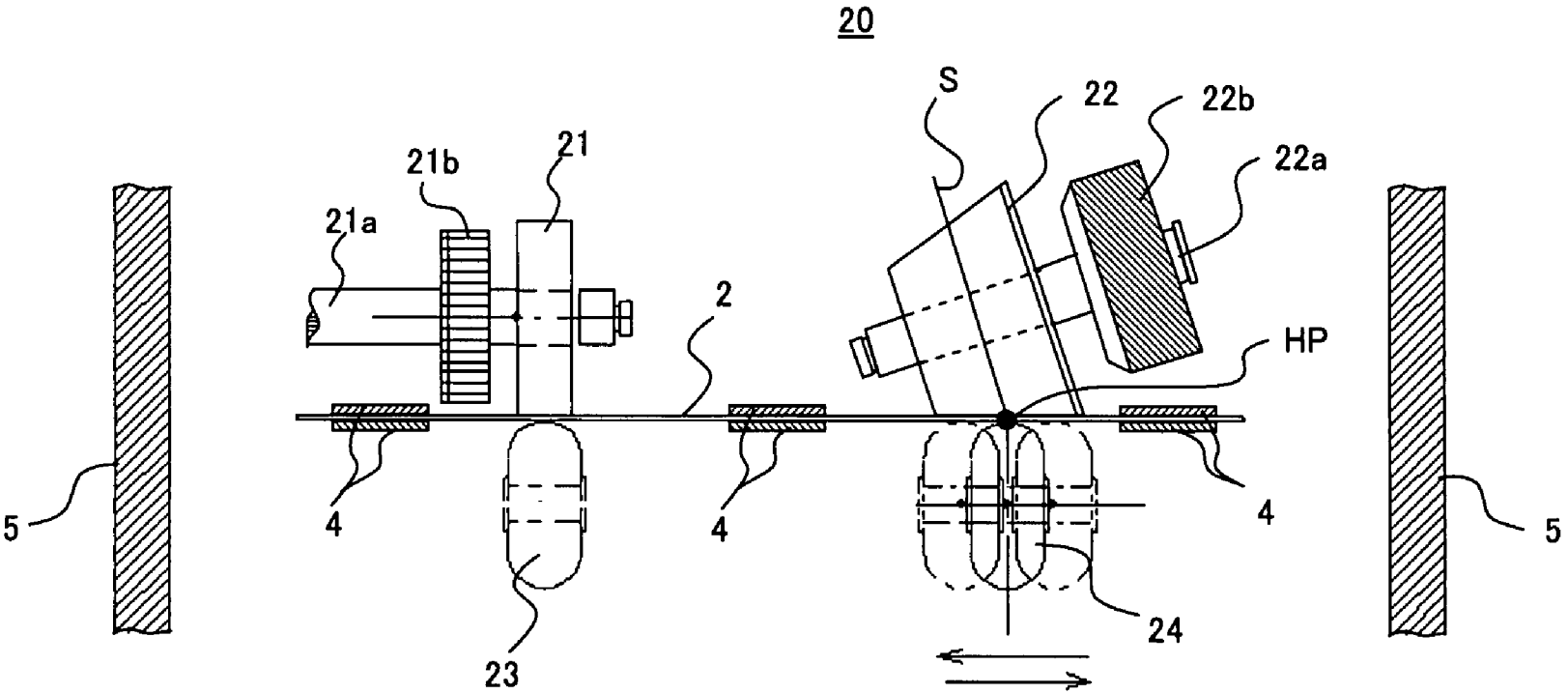
FIG. 4 is a front view of the skew correction unit.
Figure 5:
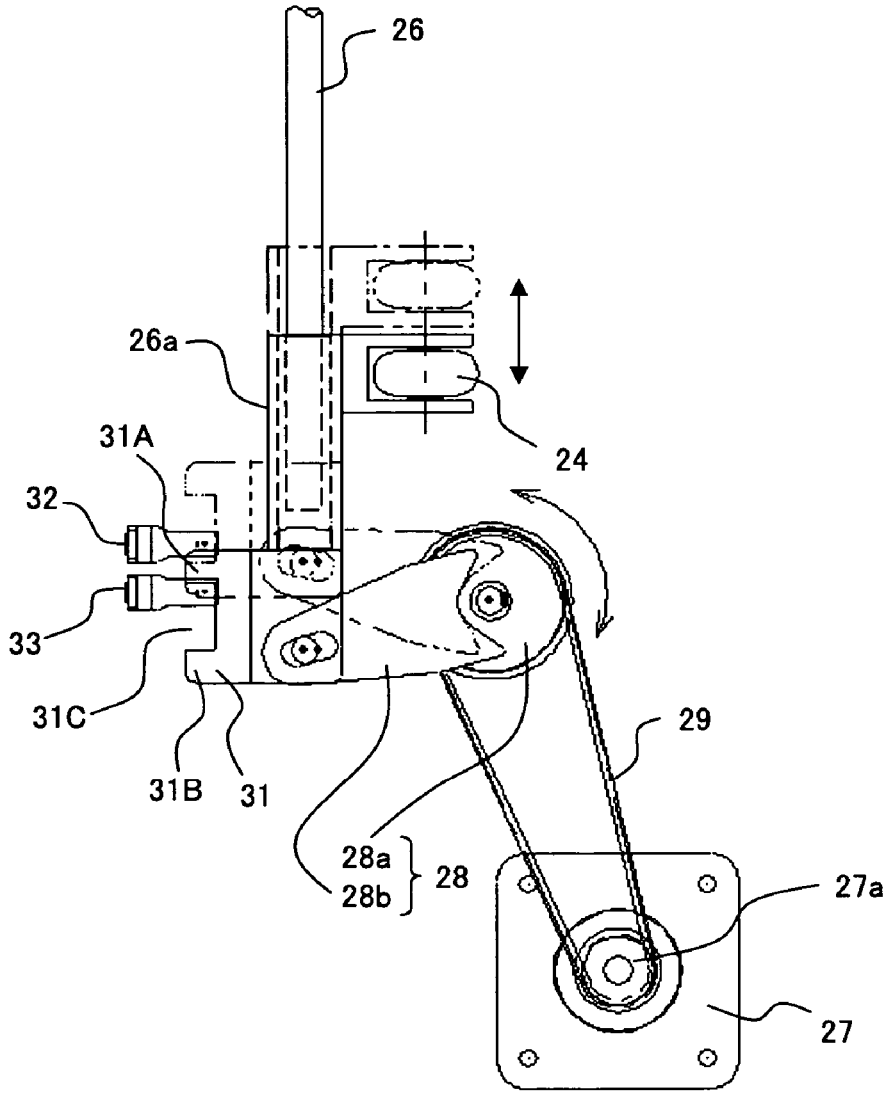
FIG. 5 is an enlarged driven roller-driving system constituting the skew correction unit.
Figure 6:
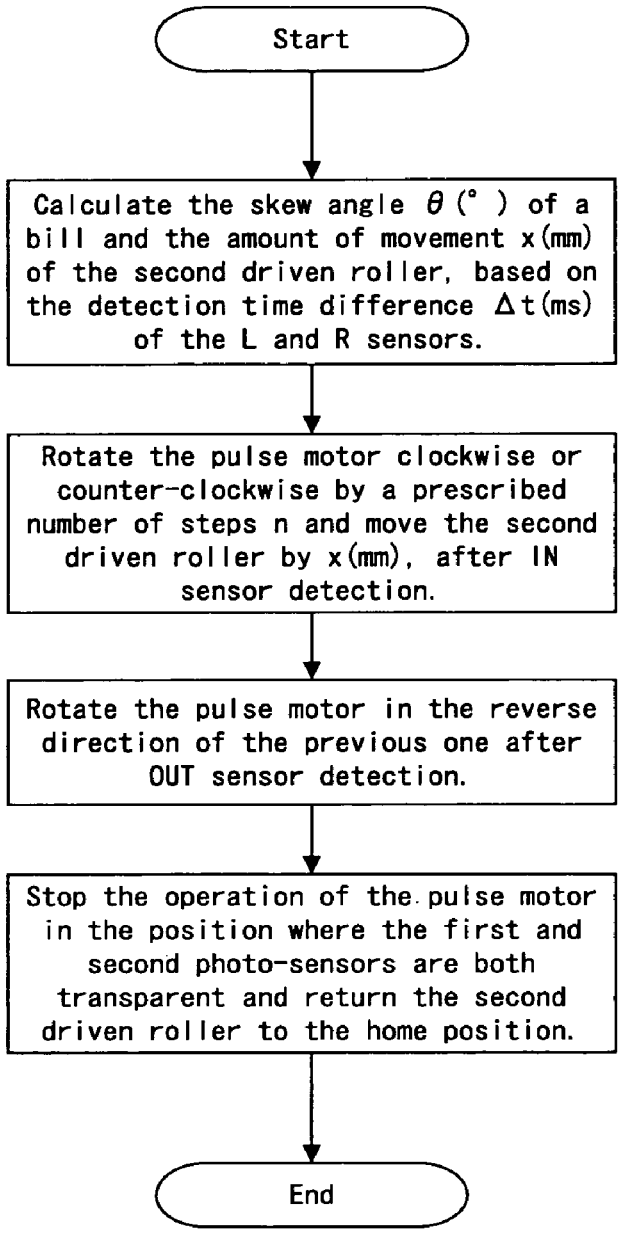
FIG. 6 is a flowchart showing the respective operational control steps of the paper skew correcting device.

FIG. 1 shows the outline of the bill depositing/dispensing apparatus in one aspect of the present invention and the paper skew correcting device constituting it in one aspect of the present invention. FIG. 2 is a top view showing the disposition of L and R sensors for detecting paper skew. FIG. 3 is the top view of the skew correction unit that is the major part of the paper skew correcting device. FIG. 4 is the front view of the skew correction unit. FIG. 5 is an enlarged driven roller-driving system constituting the skew correction unit. FIG. 6 is a flowchart showing the respective operational control steps of the paper skew correcting device.

In FIG. 1, the reference numeral 1 enclosed by a two-dot chain line represents the paper skew correcting device of this embodiment and constitutes a part of one bill depositing/dispensing apparatus for handling various types of Japanese and foreign bills (papers) 2 with different sizes. The bill depositing/dispensing apparatus comprises three conveyor belts 4 driven by a conveying roller 3, a pair of guide units 5 disposed at almost the same interval as the long side width of the largest bill 2 that can be handled and a conveying route provided with it 5 (see FIGS. 2-4 ).

The length of the long side of the largest and smallest bills that the device can handle are 86 mm and 60 mm, respectively, and the difference is 26 mm. Therefore, bills cannot be conveyed by providing guides in the direction of the long side. Since the conveying distance is long, it is most appropriate and efficient to convey the bills using a conveyor belt taking into consideration low device cost and simple configuration. Therefore, in this device, bills are conveyed using a conveyor belt. However, since papers are conveyed between a plurality of conveying rollers arranged in the conveying direction of a conveyor belt by only the pinching force of the upper and lower conveyor belts, sometimes paper skew are generated due to some reason (uneven or fall of frictional force between upper and lower conveyor belts, a broken bill and wind pressure to bills at the time of being conveyed).

In other words, this paper skew correcting device 1 aims to mainly correct skew bills 2 with a long side length that is smaller than the space between the pair of guide units 5 and 5. In order to facilitate the correction of skew bills 2, the tension of each conveyor belt 4 is set fairly loose.

The paper skew correcting device 1 comprises various sensors 11-14 vertically disposed across a conveying route composed of conveying rollers 3 and conveyor belts 4 and a skew correction unit 20 for actually correcting skew bills 2, based on detection signals from these sensors 11-14.

As shown in FIGS. 1 and 2, a left (L) sensor 11 and a right (R) sensor 12 are disposed on the uppermost stream of the conveying route. These L and R sensors 11 and 12 both are optical sensors for detecting the transmission/non-transmission of light, and are connected to a control unit, such as a microcomputer, a CPU or an MPU, which are not shown in FIGS. 1 and 2. Each of the L and R sensors 11 and 12 individually detects the transmission/non-transmission of light of the left and right sides of a conveyed bill 2 and outputs a detection signal to the control unit.

An optical IN sensor 13 and an OUT sensor 14 are disposed before and after the skew correction unit 20 on the conveying route. The IN sensor 13 detects a bill 2 that goes into the skew correction unit 20 and outputs a detection signal to the control unit. The OUT sensor 14 detects a bill 2 that comes out of the skew correction unit 20 and outputs a detection signal to the control unit.

As shown in FIGS. 1, 3 and 4, the skew correction unit 20 comprises first and second driving rollers 21 and 22 disposed to the upper left and right, respectively, of the conveying route and first and second driven rollers 23 and 24 disposed oppositely to the lower parts of the first and second driving rollers 21 and 22 via the conveying route.

The first driving roller 21 is a conventional cylindrical rubber roller with a contact surface of a specific width and is mounted on a horizontal rotation shaft 21*a*. The second driving roller (tapered roller) 22 is a frustum of cone shaped rubber roller whose small diameter side is disposed toward the center of the conveying route, and is mounted on a rotation shaft 22*a* inclined by a prescribed angle in such a way that its tapered contact surface can be horizontal to the conveying route. The diameter at the center in the width direction (see the center line S in FIG. 4) of the second driving roller 22 is the same as that of the first driving roller 21.

In this embodiment, a flat gear 21*b* is provided for the horizontal rotation shaft 21*a* of the first driving roller 21 and a helical gear 22*b* having teeth inclined in such a way that the inclination angle of the rotation shaft 22*a* is killed is mounted on the inclined rotation shaft 22*a* of the second driving roller 22. By engaging the flat gear 21*b* and the helical gear 22*b* with two flat gears 25*a* and 25*b* provided for a third rotation shaft 25 that receives power from a main bill conveying motor, which is not shown in FIGS. 1, 3 and 4. Thus, the first and second driving rollers 21 and 22 can be driven by the same driving source.

The first and second driven rollers 23 and 24 are both pinch rollers having an arc contact surface with a narrow width. The first driven roller 23 is directly fixed on the support member 26 shown in FIG. 3. However, the second driven roller 24 is mounted in such a way as to be able to slide freely in the longitudinal direction of the support member 26, that is, to the left or right side of the conveying route, via a sliding member 26*a*. Thus, since the second driven roller 24 can slide freely laterally against the second driving roller 22 (being a tapered roller) by changing its contact position with the second driving roller 22, its peripheral speed can be changed and the feeding speed of bills 2 can be accelerated or decelerated.

As shown in FIGS. 1, 4 and 5, a small pulley 27*a* is provided for the driving shaft of a pulse motor 27 different from the bill-conveying main motor as a means for laterally moving the second driven roller 24, and the small pulley 27*a* and the large pulley 28*a* on a pulley lever 28 are connected via a timing belt 29. Simultaneously, a lever unit 28*b* provided for the pulley lever 28 is connected to the above-described sliding member 26*a* in such a way as to be freely rotatable.

In order to control so as to laterally move the second driven roller 24 by a prescribed amount, the second driven roller 24 must be positioned at the home position HP of the second driving roller 22 (in this embodiment, a position that is the center in the width direction of the second driving roller 22 and where the diameter of the second driving roller 22 becomes the same as that of the first driving roller 21, that is, a position where the respective peripheral speeds of both the driving rollers 21 and 22 become the same).

Thus, in this embodiment, as shown in FIG. 5, a plate 31 that is shaped similarly to the Japanese character "コ" when viewed from the top is provided for the sliding member 26*a* and by first and second photo-sensors 32 and 33 detecting detection flags 31A and 31B or a slit 31C formed on the plate 31, the second driven roller 24 is accurately positioned at the home position HP.

Specifically, the state in which the first and second photo-sensors 32 and 33 detect neither of the detection flags 31A and 31B, that is, a transmission state in which both of the first and second photo-sensors 32 and 33 are located in the slit 31C is determined as the home position HP of the second driven roller 24.

The reference numeral 6 in FIG. 1 represents a bill discrimination unit and essentially discriminates the truth/falsehood, type, degree of damage and the like, of a bill 2 via an image sensor. In this embodiment, it further has a function to check and to store the result of skew bill correction by the paper skew correcting device 1. Thus, the bill discrimination unit 6 determines and stores the effect of skew bill correction by the bill features (size, paper quality, etc.) of different countries and feeds back the determination result in order to calculate the amount of movement of the second driven roller 24.

Next, the skew correction control of the paper skew correcting device 1 with the above-described configuration is described. When a bill 2 is conveyed by each conveyor belt 4, the L and R sensors 11 and 12 first individually detects the left and right sides of the bill 2 and output detection signals. Then, the control unit that receives these detection signals calculates the skew angle θ(°) of the bill 2 and the amount of movement x(mm) of the second driven roller 24 on the basis of the time difference Δt (ms) between the detection signals (S1 in FIG. 6).

Then, when the IN sensor 13 detects the bill 2 and outputs a detection signal, the control unit that receives the detection signal outputs a pulse signal corresponding to the amount of movement x(mm) and rotates the pulse motor 27 clockwise or counter-clockwise by a prescribed number of steps (S2 in FIG. 6). The relationship between the time difference θt (ms) of the detection signals and the number of steps is as follows.

TABLE 1

| Δt(ms) | Motor (that rotates clockwise) Number of steps | Δt(ms) | Motor (that rotates counter-clockwise) Number of steps |
|---|---|---|---|
| −1 | — | 1 | — |
| −2 | — | 2 | — |
| −3 | — | 3 | — |
| −4 | 5 | 4 | 4 |
| −5 | 7 | 5 | 5 |
| −6 | 8 | 6 | 6 |
| −7 | 9 | 7 | 7 |
| −8 | 11 | 8 | 8 |
| −9 | 12 | 9 | 9 |
| −10 | 12 | 10 | 10 |
| <−10 | 12 | 10> | 10 |

Thus, the second driven roller 24 moves in the left or right direction by x(mm) to change the peripheral speed of the second roller 21, which is a tapered roller. As a result, the feeding speed of the left side is accelerated or decelerated to correct the skew bill 2.

Then, when the OUT sensor 14 detects the bill 2 and outputs a detection signal, the control unit that receives the detection signal outputs a pulse signal to rotate the pulse motor 27 in the reverse direction of the previous rotation (S3 in FIG. 6). Then, when the first and second photo-sensors 32 and 33 both become transparent, the control unit stops the output of the pulse signal and returns the second driven roller 24 to the home position (S4 in FIG. 6). Thus, the paper skew correcting device 1 enters the skew correction waiting state of the bill 2 that is to be subsequently conveyed.

Although in this example, the paper skew correcting device 1 corrects a skew of bill 2 by moving the second driven roller 24 by a prescribed amount, the amount of movement x (mm) of the second driven roller 24 needed to correct a skew of bill 2 can be calculated as follows.

Figure 7:
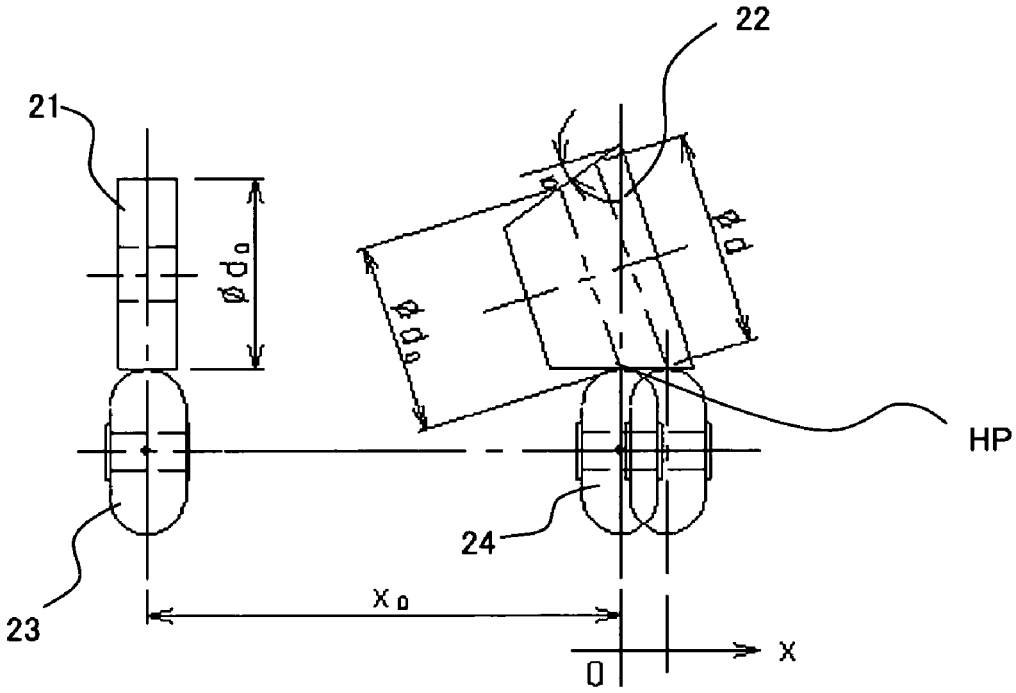
FIG. 7 shows front views of the respective rollers indicating a variety of parameters used to calculate the amount of movement x(mm) of the second driven roller needed to correct paper skew (No. 1).
Figure 8:
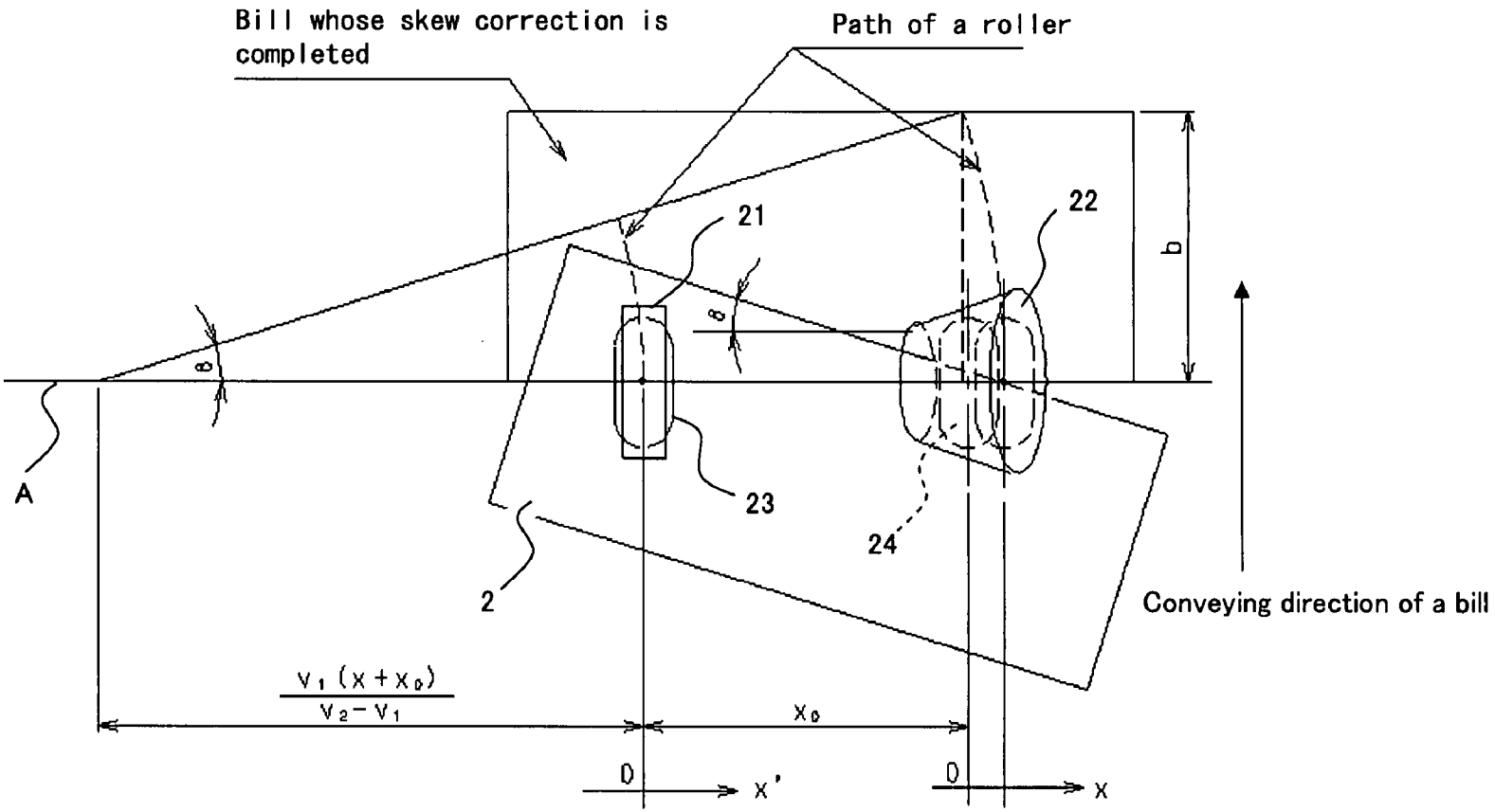
FIG. 8 shows front views of the respective rollers indicating a variety of parameters used to calculate the amount of movement x (mm) of the second driven roller needed to correct paper skew (No. 2).

In FIGS. 7 and 8 it is assumed that the diameter of the first driving roller 21, the distance between the center of the first driven roller 23 and the center of the second driven roller 24 positioned in the home position HP are d0 (mm) and x0 (mm), respectively. The coordinate x axis is assumed horizontally and it is also assumed that a value on the coordinate axis x is the amount of movement x(mm) of the second driven roller 24 and that the diameter of the second driven roller 22 in the case where the second driven roller 24 moves by x(mm) to touch the bill 2 is d(mm). In this case, the taper slope of the second driving roller 22 is α(°), and the diameter d(mm) of the second driving roller 22 can be expressed as follows.

[Mathematical Expression 1 ]

$$d=2x\sin\alpha+d_0 \tag{1}$$

If the number of revolutions of the first driving roller 21 is a, the peripheral speed v1 can be expressed as follows.

[Mathematical Expression 2]

$$v_1=d_0\pi a \tag{2}$$

If the second driven roller 24 moves by x(mm) in the same number of revolutions as described above, the peripheral speed v2 of the second driving roller 22 can be expressed as follows.

[Mathematical Expression 3]

$$v_2=d\pi a=(2x\sin\alpha+d_0)\pi a \tag{3}$$

If a coordinate x' axis is assumed in order to indicate the position of a bill 2 on the straight line A in FIG. 8 when a bill 2 with a short side width b(mm) is conveyed at a skew angle, speed v in the case where the pair of left and right rollers 21-24 feed the bill 2 can be expressed as follows, using a value on the coordinate axis x' (however, the direction of the feeding speed v is orthogonal to the straight line A).

[Mathematical Expression 4]

$$v=v_1+\frac{v_2-v_1}{x+x_0}x' \tag{4}$$

According to equation (4), the feeding speed v of the bill 2 which is x' in equation (5) becomes zero (V=0)(however, x' can sometimes be located outside of the bill 2).

[Mathematical Expression 5]

$$x'=-\frac{v_1(x+x_0)}{v_2-v_1} \tag{5}$$

Since the bill 2 rotates using x' as a center, in order to complete skew correction before the bill 2 passes between the pair of left and right rollers 21-24, as shown in FIG. 8, the following equation must be satisfied.

[Mathematical Expression 6]

$$\sin\theta=\frac{b}{\frac{v_1(x+x_0)}{v_2-v_1}+(x+x_0)} \tag{6}$$

If equations (2) and (3) are assigned to equation (6), equation (7) can be obtained.

[Mathematical Expression 7]

$$\sin\theta=\frac{b}{(x+x_0)\left(\frac{d_0}{2x\sin\alpha}+1\right)} \tag{7}$$

If x is calculated according to equation (7), the amount of movement x(mm) of the second driven roller 24 needed to correct the skew bill 2 can be expressed as follows.

[Mathematical Expression 8]

$$x = -\frac{1}{4}\left(\frac{d_0}{\sin\alpha} + 2x_0 - \frac{2b}{\sin\theta}\right) - \frac{1}{2}\sqrt{\frac{1}{4}\left(\frac{d_0}{\sin\alpha} + 2x_0 - \frac{2b}{\sin\theta}\right)^2 - \frac{2x_0 d_0}{\sin\alpha}} \quad (8)$$

Figure 9A:
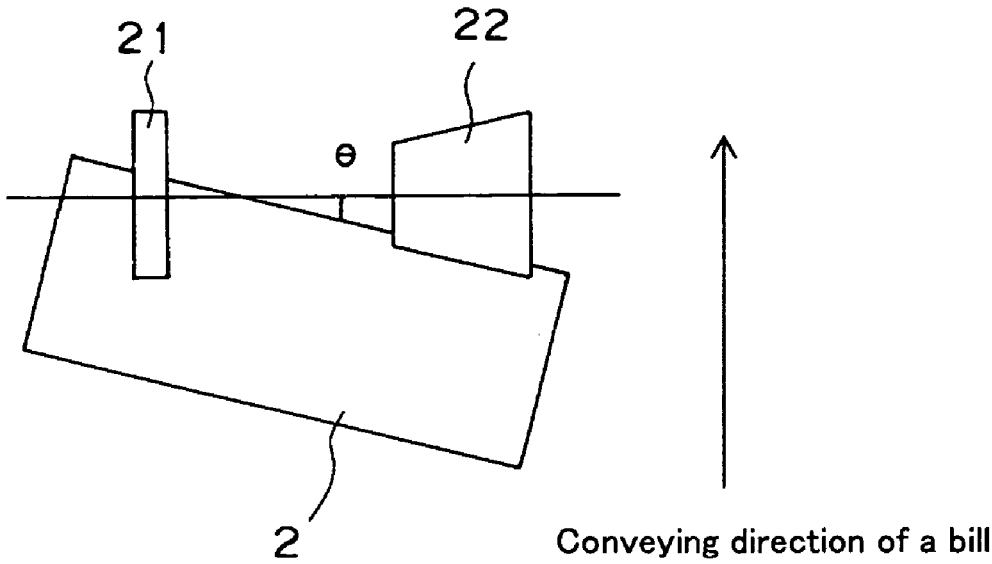
FIGS. 9A and 9B show paper skew and the skew angle θ(°).
Figure 9B:
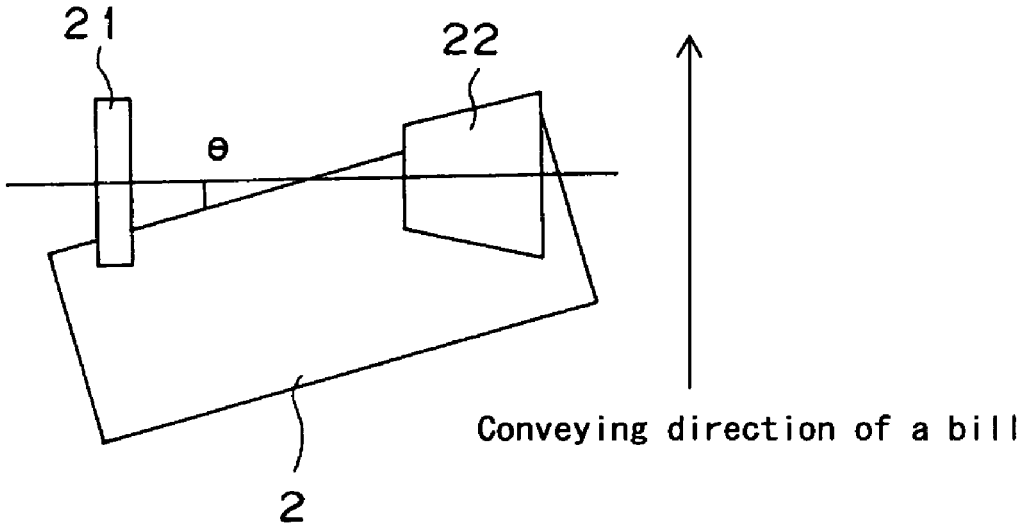

As shown in FIGS. 8 and 9A, equation (8) presumes that the feeding speed v of the right side of the bill 2 whose left side moves aslant in advance is accelerated. Conversely, the amount of movement x (mm) of the second driven roller 24 needed to correct the bill 2 whose right side moves aslant in advance by decelerating the feeding speed v of the left side of the bill 2 whose right side moves aslant in advance can be expressed as follows (however, the skew angle θ(°) of the bill 2 is determined as shown in FIG. 9B).

[Mathematical Expression 9]

$$x = -\frac{d_0 x_0 \sin\theta}{2b\sin\alpha + d_0\sin\theta} \quad (9)$$

The following calculation is made according to equation (9) with the following values: the diameter of the first driving roller d0 , the short side width of the bill b, the taper slope α of the second driving roller and the distance between the center of the first driven roller and the center of the second driven roller positioned in the home position x0 are 21 mm, 76 mm, 18° and 50 mm, respectively. In this case, the amount of feeding per step of the pulse motor is 0.25 mm at the 1-2 phase excitation.

The amount of movement x (mm) of the second driven roller, needed to correct the skew angle θ=3~12(°) of a bill was calculated. The result is as follows.

TABLE 2

| Amount of movement x(mm) needed to correct skew angle θ° | | Side accelerated by tapered roller θ (°) | Side accelerated by tapered roller x (mm) | Side decelerate by tapered roller θ (°) | Side decelerate by tapered roller x (mm) |
|---|---|---|---|---|---|
| ① Side accelerated by tapered roller | 1 | 12 | 6.16915543 | 12 | −4.252457862 |
| | 2 | 11 | 5.501306237 | 11 | −3.93014883 |
| $x = -\frac{1}{4}\left(\frac{21}{\sin 18} + 2\times 50 - \frac{2\times 76}{\sin\theta}\right) -$ | 3 | 10 | 4.870560531 | 10 | −3.602147195 |
| | 4 | 9 | 4.273251365 | 9 | −3.268408672 |
| | 5 | 8 | 3.706249305 | 8 | −2.92889016 |
| $\frac{1}{2}\sqrt{\frac{1}{4}\left(\frac{21}{\sin 18} + 2\times 50 - \frac{2\times 76}{\sin\theta}\right)^2 - \frac{2\times 50\times 21}{\sin 18}}$ | 6 | 7 | 3.16686083 | 7 | −2.583549881 |
| | 7 | 6 | 2.652749875 | 6 | −2.232347533 |
| | 8 | 5 | 2.161876407 | 5 | −1.875244445 |
| ② Side decelerate by tapered roller | 9 | 4 | 1.69244777 | 4 | −1.512203738 |
| | 10 | 3 | 1.242879714 | 3 | −1.143190506 |
| $x = -\frac{50\times 21\times\sin\theta}{2\times 76\times\sin 18 + 21\times\sin\theta}$ | | | | | |

The amount of skew correction θ(°) in the case where the second driven roller is moved by x=1~6(mm) was calculated. The result is as follows.

TABLE 3

| Amount of skew correction θ° in the case where the second driven roller is moved by x (mm) | | Side accelerated by tapered roller x (mm) | Side accelerated by tapered roller θ (°) | Side decelerate by tapered roller x (mm) | Side decelerate by tapered roller θ (°) |
|---|---|---|---|---|---|
| ① Side accelerated by tapered roller | 1 | 6 | 11.75222776 | −6 | 17.75839172 |
| | 2 | 5 | 10.20979099 | −5 | 14.39004556 |
| $\theta = \sin^{-1}\left(\frac{76}{(x+50)\left(\frac{21}{2\times\sin\alpha} + 1\right)}\right)$ | 3 | 4 | 8.524434854 | −4 | 11.21523425 |
| | 5 | 2 | 4.660110103 | −3 | 8.208034662 |
| | 6 | 1 | 2.441707715 | −2 | 5.347474613 |
| | 7 | 0 | — | 0 | — |
| ② Side decelerate by tapered roller | | | | | |
| $\theta = \sin^{-1}\left(\frac{-152\times\sin 18}{21\,(50+x)}\right)$ | | | | | |

The skew angle θ(°) and the amount of movement x (mm) of the second driven roller needed to correct it in the case where the detection time difference between the L and R sensors Δt is 1~10(ms) (Δt=1~10(ms)) were calculated. The result is as follows.

TABLE 4

| 1 Necessary amount of movement x(mm) by sensor skew detection time difference t(ms) | | t(ms) | θ (°) | Side to be accelerated (+correction) x (mm) | Motor (clockwise) Number of steps | Side to be decelerated (−correction) x (mm) | Motor (counter-clockwise) Number of steps |
|---|---|---|---|---|---|---|---|
| θ° = tan − 1(1.2*t/50) | 1 | 1 | 1.374834781 | 0.551057028 | 2.20422811 | −0.530659162 | −2.12263665 |
| t = 50*tanθ/1.2 | 2 | 2 | 2.74808818 | 1.132589829 | 4.530359317 | −1.049286002 | −4.197144007 |
| | 3 | 3 | 4.118189704 | 1.746865413 | 6.987461653 | −1.555421984 | −6.221687936 |
| | 4 | 4 | 5.483590444 | 2.396475004 | 9.585900017 | −2.048675256 | −8.194701024 |
| | 5 | 5 | 6.842773413 | 3.084409551 | 12.3376382 | −2.528720924 | −10.11488369 |
| | 6 | 6 | 8.194263335 | 3.814157444 | 15.25662978 | −2.995300502 | −11.98120201 |
| | 7 | 7 | 9.536635758 | 4.589832708 | 18.35933083 | −3.448220602 | −13.79288241 |
| | 8 | 8 | 10.86852534 | 5.416345816 | 21.66538326 | −3.887350908 | −15.54940363 |
| | 9 | 9 | 12.1886332 | 6.299635501 | 25.198542 | −4.312621553 | −17.25048621 |
| | 10 | 10 | 13.49573328 | 7.246990031 | 28.98796012 | −4.724019952 | −18.89607981 |

As described above, according to the paper skew correcting device 1 of this embodiment, by changing the contact position of the second driving roller 22, which is a tapered roller, and the second driven roller 24 on the basis of the skew angle θ(°) of a conveyed bill 2, the peripheral speed v2 of the second driving roller 22 can be changed to accelerate/decelerate the feeding speed v of only the right side of a bill 2 and to correct a skew bill 2 with high accuracy without applying unnecessary force to the bill 2.

Since in the paper skew correcting device 1 of this embodiment the first and second driving rollers 21 and 22 are driven by the same driving source, the configuration of the entire device can be simplified, thereby simplifying its control, reducing the number of operational failures and reducing its cost.

Furthermore, since in the paper skew correcting device 1 of this embodiment the driving force of the pulse motor 27 is conveyed to the second driven roller 24 via the small pulley 27*a* and the large pulley 28*a* to laterally move it, by increasing the ratio in size between the large and small pulleys the second driven roller 24 can be moved finely by one step of the pulse motor 27, thereby correcting a skew bill 2 with high accuracy.

In addition to this, since by the first and second photosensors 32 and 33 detecting the detection flags 31A and 31B, respectively, provided for the sliding member 26*a* and the second driven roller 24 is positioned in the home position of the second driving roller 22, the second driven roller 24 can be accurately positioned in the home position HP, thereby correcting a skew bill 2 with higher accuracy in corporation with the fine movement of the second driven roller 24 by the above-described pulse motor 27.

By correcting a skew bill during conveying (correcting in such a way as to mitigate skew), its rejection ratio in the bill discrimination unit provided later can be reduced, thereby shortening transaction time. Specifically, the discrimination unit can discriminate even a somewhat skew bill. To accomplish that, a bill is read as an image which is rotated and is compared with a reference image. Therefore, if the amount of skew of a bill is large and the amount of rotation is thus large then the processing speed will be reduced. Therefore, in order to maintain the discrimination ratio while maintaining the processing speed, if a bill is skewed beyond a prescribed angle, the bill is rejected because cannot be discriminated. Therefore, if the configuration of the present invention is adopted, the amount of skew of a conveyed bill can be reduced and its angle can be corrected up to the amount of skew that the bill discrimination unit can discriminate, the number of bills that are rejected because they cannot be discriminated can be reduced. A customer can re-input a bill that is returned because it could not be discriminated or the like in the case of deposits and payments and the device can take in the bill again. Therefore, if many bills are rejected, this process will be repeated many times and the operation time of one transaction will be lengthened. Therefore, if the number of rejected bills can be reduced, the time required for one transaction can be shortened.

The paper skew correcting device of the present invention is not limited to the above-described embodiments. For example, although in the above-described embodiments the paper skew correcting device 1 is used as a part of a bill depositing/dispensing apparatus such as an ATM or the like to correct a skew bill 2, its application is not limited to this. The device can also be widely used to correct many kinds of paper skew, such as bankbooks, tickets, merchandise coupons, checks, credit cards, securities, debentures and the like.

Figure 10:
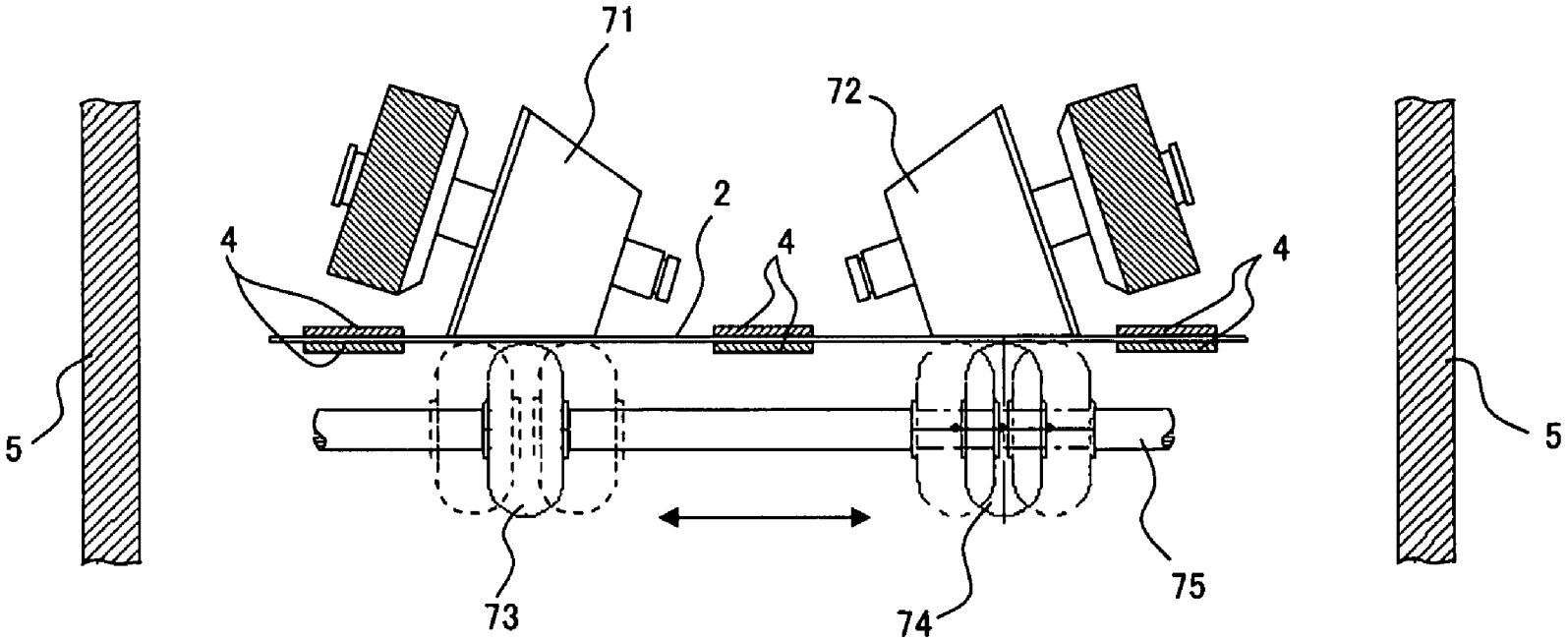
FIG. 10 is a front view of a variation of the paper skew correcting device.
Figure 11A:
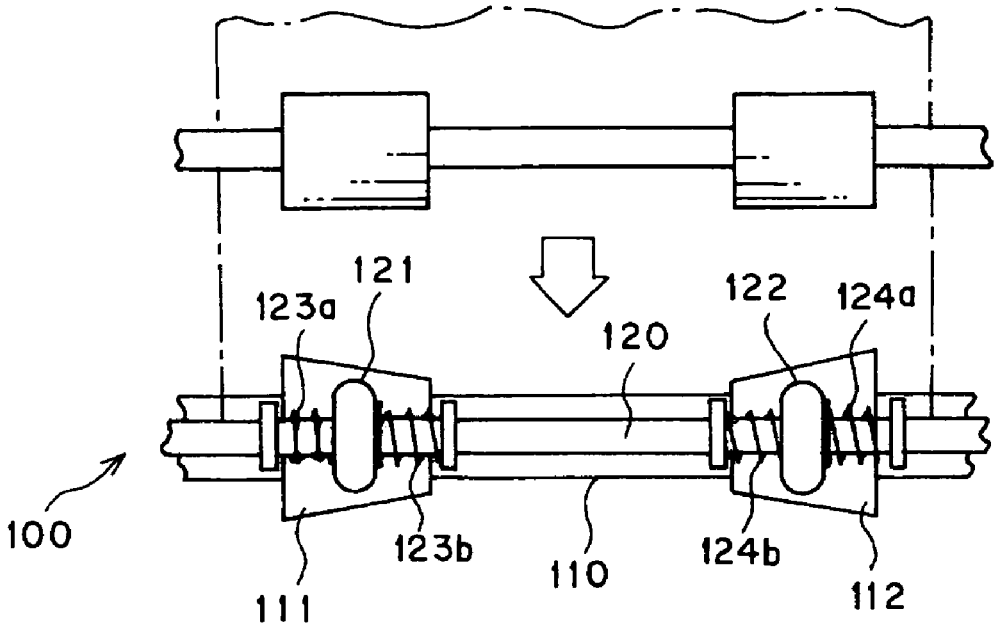
FIGS. 11A and 11B show a conventional paper skew correcting device.
Figure 11B:
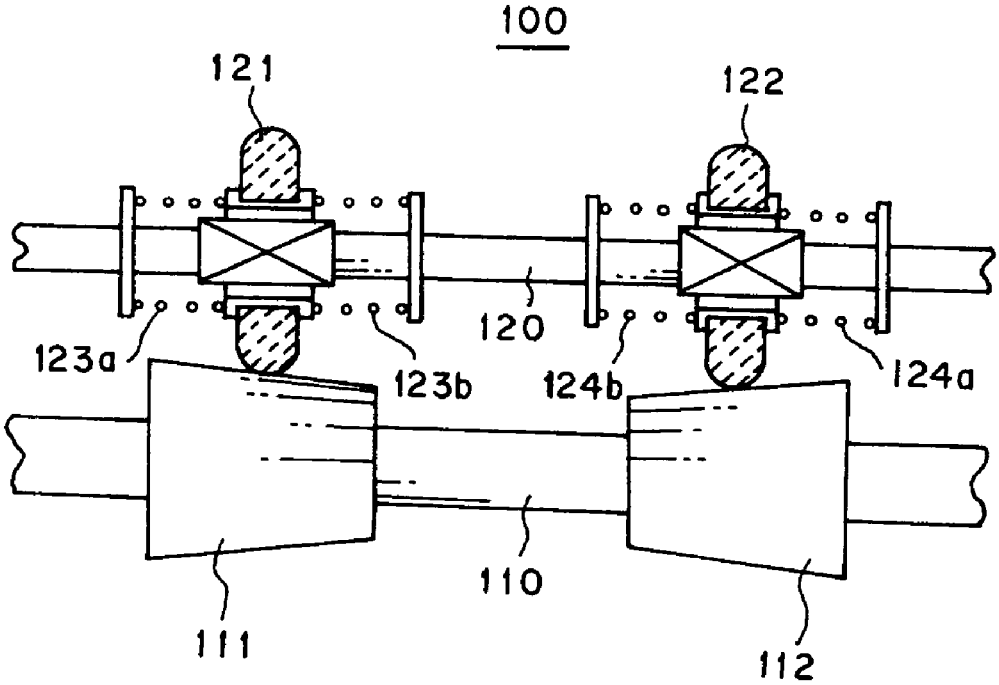

Although in the above-described embodiments only the second driving roller 22 and the second driven roller 24, which are provided to the right of the paper conveying route, correct paper skew, skew correction is not limited to these. For example, as shown in FIG. 10, the first and second driving rollers 71 and 72 can also both be configured as tapered rollers and paper skew can also be corrected by laterally moving the first and second driven rollers 73 and 74, which touch these tapered rollers simultaneously. In such a configuration, the amount of movement of each of the driven rollers 73 and 74 can be reduced by half and paper skew can be corrected more speedily.

If the first and second driven rollers 73 and 74 are mounted on the same rotation shaft 75 and are simultaneously moved by the same driving source, which is not shown in FIG. 10, the configuration of the entire device can be simplified, thereby simplifying its control, reducing the number of operational failures and reducing its cost.

What is claimed is:

1. A paper skew correcting device, comprising:

first and second driving rollers disposed on the left and right sides of a paper conveying route; and first and second driven rollers with narrow contact surfaces disposed opposite to the first and second driving rollers via the conveying route in which the first and second driving rollers touch the first and second driven rollers, respectively, and papers are pinched by their left and right sides and are fed, wherein one of either the first or second driving rollers is formed in a tapered roller with a tapered outer peripheral surface and its rotation shaft is provided aslant in such a way that the contact part of the tapered roller is almost parallel with the conveying route, and by laterally moving one of either the first or second driven rollers disposed opposite to the tapered roller, according to the skew angle of the conveyed papers, in order to change its contact position with the tapered roller, whereby the feeding speed of the left or right side of the papers can be accelerated or decelerated to correct the paper skew.

2. The paper skew correcting device according to claim 1, wherein the first and second driving rollers are driven by the same driving source.

3. The paper skew correcting device according to claim 1, as a means for laterally moving the first or/and second driven rollers, further comprising:

a pulse motor with a small pulley provided for a driving shaft;

a pulley lever with a lever unit extending in the direction orthogonal to its rotation shaft provided for a large pulley;

a timing belt for conveying rotation of the small pulley to the large pulley; and a sliding member, on which the first and/or second driven rollers are mounted, that is connected to the pulley lever and linearly moves leftward or rightward when receiving a driving force from the pulse motor.

4. The paper skew correcting device according to claim 2, as a means for laterally moving the first or/and second driven rollers, further comprising:

a pulse motor with a small pulley provided for a driving shaft;

a pulley lever with a lever unit extending in the direction orthogonal to its rotation shaft provided for a large pulley;

a timing belt for conveying rotation of the small pulley to the large pulley; and a sliding member, on which the first and/or second driven rollers are mounted, that is connected to the pulley lever and linearly moves leftward or rightward when receiving a driving force from the pulse motor.

5. The paper skew correcting device according to claim 1, wherein the first and/or second driven rollers are positioned in the home positions of the first and/or second driving rollers, respectively, based on output signals from one or more photo-sensors for detecting a detection flag provided by a sliding member.

6. The paper skew correcting device according to claim 2, wherein the first and/or second driven rollers are positioned in the home positions of the first and/or second driving rollers, respectively, based on output signals from one or more photo-sensors for detecting a detection flag provided by a sliding member.

7. The paper skew correcting device according to claim 3, wherein the first and/or second driven rollers are positioned in the home positions of the first and/or second driving rollers, respectively, based on output signals from one or more photo-sensors for detecting a detection flag provided for the sliding member.

8. The paper skew correcting device according to claim 4, wherein the first and/or second driven rollers are positioned in the home positions of the first and/or second driving rollers, respectively, based on output signals from one or more photo-sensors for detecting a detection flag provided for the sliding member.

9. A paper skew correcting device, comprising:

first and second driving rollers disposed on the left and right sides of a paper conveying route; and first and second driven rollers with narrow contact surfaces disposed opposite to the first and second driving rollers via the conveying route, in which the first and second driving rollers touch the first and second driven rollers, respectively, and papers are pinched by their left and right sides and are fed, wherein both of the first and second driving rovers are configured as tapered rollers with a tapered outer peripheral surface and the respective large or small diameter end surfaces of these tapered rollers are symmetrically disposed in such a way as to be opposed to each other, and also each rotation shaft is provided aslant in such a way that a contact part of each tapered roller can be nearly parallel with the conveying surface, and by laterally moving the first and second driven rollers disposed opposite to the tapered rollers according to the skew angle of the conveyed papers, thereby changing its contact position with each tapered roller, the feeding speed of either of the left sides or right sides of the papers can be accelerated and the feeding speed of the other can be decelerated.

10. The paper skew correcting device according to claim 9, wherein the first and second driving rollers are driven by the same driving source.

11. The paper skew correcting device according to claim 9, wherein the first and second driven rollers are fixed on the same rotation shaft and also are laterally moved by the same driving source simultaneously.

12. The paper skew correcting device according to claim 9, as a means for laterally moving the first or/and second driven rollers, further comprising:

a pulse motor with a small pulley provided for a driving shaft;

a pulley lever with a lever unit extending in the direction orthogonal to its rotation shaft provided for a large pulley;

a timing belt for conveying rotation of the small pulley to the large pulley; and a sliding member, on which the first and/or second driven rollers are mounted, that is connected to the pulley lever and linearly moves leftward or rightward when receiving a driving force from the pulse motor.

13. The paper skew correcting device according to claim 10, as a means for laterally moving the first or/and second driven rollers, further comprising:

a pulse motor with a small pulley provided for a driving shaft;

a pulley lever with a lever unit extending in the direction orthogonal to its rotation shaft provided for a large pulley;

a timing belt for conveying rotation of the small pulley to the large pulley, and a sliding member, on which the first and/or second driven rollers are mounted, that is connected to the pulley lever and linearly moves leftward or rightward when receiving a driving force from the pulse motor.

14. The paper skew correcting device according to claim 11, as a means for laterally moving the first or/and second driven rollers, further comprising:

a pulse motor with a small pulley provided for a driving shaft;

a pulley lever with a lever unit extending in the direction orthogonal to its rotation shaft provided for a large pulley;

a timing belt for conveying rotation of the small pulley to the large pulley; and a sliding member, on which the first and/or second driven rollers are mounted, that is connected to the pulley lever and linearly moves leftward or rightward when receiving a driving force from the pulse motor.

15. The paper skew correcting device according to claim 9, wherein the first and/or second driven rollers are positioned in the home positions of the first and/or second driving rollers, respectively, based on output signals from one or more photo-sensors for detecting a detection flag provided by a sliding member.

16. The paper skew correcting device according to claim 10, wherein the first and/or second driven rollers are positioned in the home positions of the first and/or second driving rollers, respectively, based on output signals from one or more photo-sensors for detecting a detection flag provided by sliding member.

17. The paper skew correcting device according to claim 11, wherein the first and/or second driven rollers are positioned in the home positions of the first and/or second driving rollers, respectively, based on output signals from one or more photo-sensors for detecting a detection flag provided by a sliding member.

18. The paper skew correcting device according to claim 12, wherein the first and/or second driven rollers are positioned in the home positions of the first and/or second driving rollers, respectively, based on output signals from one or more photo-sensors for detecting a detection flag provided for the sliding member.

19. The paper skew correcting device according to claim 14, wherein the first and/or second driven rollers are positioned in the home positions of the first and/or second driving rollers, respectively, based on output signals from one or more photo-sensors for detecting a detection flag provided for the sliding member.

20. A bill depositing/dispensing apparatus, provided with the paper skew correcting device according to claim 1, in the middle of a conveying route, for correcting a skew bill that is a piece of paper.

* * * * *